US005799636A

United States Patent [19]

Fish

[11] Patent Number: 5,799,636

[45] Date of Patent: Sep. 1, 1998

[54] SPLIT CYCLE ENGINES

[76] Inventor: Robert D. Fish, 3000 S. Augusta Ct., La Habra, Calif. 90631

[21] Appl. No.: 613,676

[22] Filed: Mar. 16, 1996

[51] Int. Cl.[6] ..... F02B 75/32

[52] U.S. Cl. ..... 123/197.4

[58] Field of Search ..... 123/39, 197.4, 123/197.3

[56] References Cited

U.S. PATENT DOCUMENTS

| | | | |
|---|---|---|---|
| 3,886,805 | 6/1975 | Koderman | 123/197.4 |
| 4,215,659 | 8/1980 | Lowther | 123/39 |
| 4,966,043 | 10/1990 | Frey | 123/197.4 |
| 5,067,456 | 11/1991 | Beachley et al. | 123/197.4 |
| 5,158,047 | 10/1992 | Schaal et al. | 123/197.4 |

FOREIGN PATENT DOCUMENTS

| | | | |
|---|---|---|---|
| 3233314 | 3/1984 | Germany | 123/197.4 |
| WO 95/12772 | 5/1995 | WIPO . | |

*Primary Examiner*—Marguerite McMahon
*Attorney, Agent, or Firm*—Crockett & Fish; Robert D. Fish

[57] ABSTRACT

An internal combustion engine has a compression stroke which is shorter than the corresponding the expansion (power) stroke. In a preferred class of designs this is accomplished by carrying the crank pin on a planetary gear such that the crank pin traces out a substantially hypocycloid path.

12 Claims, 1 Drawing Sheet

SPLIT CYCLE ENGINES

FIELD OF THE INVENTION

The present invention relates to reciprocating internal combustion engines.

BACKGROUND OF THE INVENTION

All known reciprocating internal combustion engines can be classified as either four-stroke or two-stroke engines. Four-stroke engines have an air intake stroke, a compression stroke, an expansion (power) stroke, and finally a scavenging stroke, spread out across 720° of crankshaft rotation. While four stroke engines are extremely popular and numerous advancements have increased fuel economy and reduced pollution levels, four-stroke engines still suffer from the inherent inefficiency that the piston must travel four full strokes for every one power stroke. In theory, two-stroke engines can produce twice as much power (energy per unit time) for a given size engine because they have only a compression stroke and a power stroke during each rotation of the crankshaft, but in practice two-stroke engines only produce about 30% more power because of scavenging and intake problems.

Despite numerous advances in valving, combustion, lubrication and the like, both four- and two-stroke engines still suffer from inherent efficiency problems caused by their basic designs. Thus, there is still a need for a new class of engines having greater efficiency.

SUMMARY OF THE INVENTION

The present invention introduces for the first time "split-cycle" engines—engines in which the compression stroke has a different length from the power stroke. While there are many different ways of accomplishing this purpose, a preferred class of designs carries the crank pin on a planetary gear in a hypocycloid motion. Split-cycle engines are capable of combining four distinct strokes into a single 360° turn of the crankshaft.

BRIEF DESCRIPTION OF THE DRAWINGS

In the drawing, wherein similar reference characters denote corresponding elements throughout the several views.

DETAILED DESCRIPTION

Several previous publications were directed to increasing efficiency of internal combustion engines by carrying a crank pin along a non-circular path. For example, Fish WO 95/12772; Fish U.S. Pat. No. 5,482,015; Koderman U.S. Pat. No. 3,886,805; and Schall, U.S. Pat. No. 5,158,047 all disclose methods and devices for moving crank pins along one or more of elliptical, triangular square, pentagonal and linear paths. Since many of the basic principles applicable to the present invention have already been disclosed in these earlier publications, we will concentrate herein only on the differences over these earlier publications.

Figure 1:
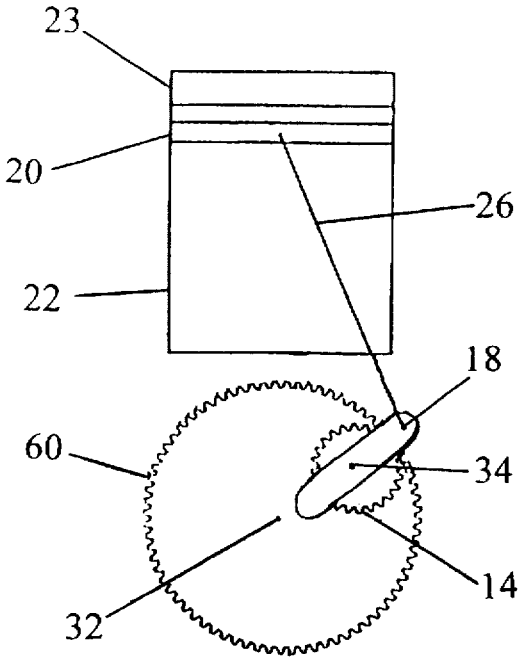
FIG. 1 is a schematic of a single cylinder of an internal combustion engine or other device according to the present invention, showing the relationship of planetary and internal gears.
Figure 2:
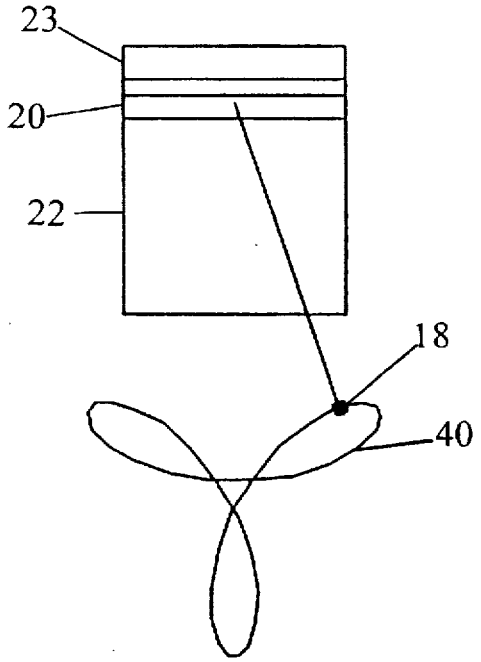
FIG. 2 is a schematic of the cylinder of FIG. 1 showing the hypocycloid path of the crank pin.

Thus, with reference to the embodiment of FIGS. 1 and 2, an engine is similar to previous disclosures in that a piston 20 is disposed within a cylinder 22 and reciprocates up and down relative to a cylinder head 23. Piston 20 is coupled to a planetary gear 60 through a connecting rod 26 and a crank pin 18, and planetary gear 60 meshes with an internal gear 14 and rotates about its own peripheral axis 34 while revolving about the central axis 32 of the internal gear 14. As used herein, reciprocation refers to cyclical movements in which at least part of the movement is retraced during a single cycle, rotation refers to an object turning about an internal axis, (an axis passing through the object), and revolution refers to an object moving in an orbit other than its own internal axis of rotation. Where a single object has a compound motion in which it both rotates and revolves, the axis of rotation is sometimes referred to as the peripheral axis, and the axis of revolution is sometimes referred to as the central axis.

There are other aspects of the previous disclosures which are also applicable to the present invention, but which are not expressly restated here for the sake of simplicity. For example, stabilizing gears (not shown) may be used to assist in maintaining the relative positions of the planetary gears 60 and the internal gears 14, and the motions of several planetary gears 60 may be coupled through connecting pieces (not shown). In addition, the entire crank path may be rotated by manipulating by the relative timing of the rotation and revolution of planetary 60 with respect to internal gear 14. Variable porting may also be used.

In the particular example of FIGS. 1 and 2, planetary gear 60 has one-third (⅓) the number of teeth of internal gear 14. Unlike previous disclosures with a 1:3 gear ratio, however, the crank pin 18 of FIGS. 1 and 2 does not travel in a substantially triangular path, but instead traces out a substantially hypocycloid shaped path 40. This is accomplished by positioning crank pin 18 sufficiently far away from peripheral axis 34. By utilizing the hypocycloid path to produce intake, compression, power and scavenging strokes within a single 360° rotation of the crankshaft, the new arrangement effectively produces a cross between a two-stroke and a four-stroke engine. This is best understood by reference to FIG. 3.

Figure 3:
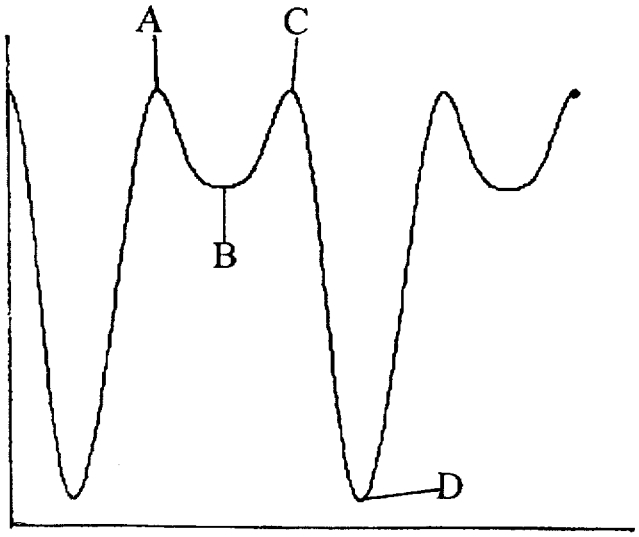
FIG. 3 is a graph showing the relative height of the piston above the central axis (vertical axis) as a function of crankshaft angle (horizontal axis) for the cylinder of FIG. 1.

In FIG. 3 points A through D correspond to one full rotation (360°) of the crankshaft. Fresh air enters the cylinder between A and B, and fresh air is compressed between B and C. For carbureted engines the fuel is brought into the cylinder along with the fresh air, and for fuel injected engines the fuel is injected between B and C. Ignition occurs near C, whether by spark ignition or by diesel detonation, and the combusted fuel is then expanded from C to D. Spent gases are exhausted between D and A. In short, all four distinct strokes of a conventional four-stroke engine are compacted into a single 360° cycle, with the power and scavenging strokes having greater lengths than the intake and compression strokes. Viewed another way, the split-cycle design produces a path with two top dead center points and two bottom dead center points during a single rotation of the crankshaft.

There are numerous potential advantages to split-cycle engines. First, by compacting distinct intake, compression, power and scavenging strokes within a single 360° cycle, a split-cycle engine combines the inherently efficient scavenging and intake of a four-stroke engine with the inherently efficient power/weight ratio of a two-stroke engine. Second, by using a turbocharger or supercharger (not shown) in conjunction with the relatively longer power stoke, the engine can make more efficient use of a wide range of charges and mixtures than was previously possible. Third, since the compression occurs over a very short period of time and the working fluid is quickly expanded in the power stroke, there should be less formation of NOx and SOx pollutants.

Thus, an entirely new combustion cycle and an entirely new class of internal combustion engine designs has been disclosed. While specific embodiments and applications have been shown and described, it would be apparent to those skilled in the art that many more modifications are possible without departing from the inventive concepts herein. To cite just a few examples, the gear ratio between planetary and internal gear can be a number other than 3:1, and the distance from the crank pin to the peripheral axis can be modified such that relative lengths of the compression stroke and power stroke can be varied from just under 100% to less than 70%, or even less than 50%. The invention, therefore, is not to be restricted except in the spirit of the appended claims.

What is claimed is:

1. An internal combustion engine comprising a piston reciprocating in a cylinder, said piston having a compression stroke and a power stroke having fixed lengths, wherein the length of the compression stroke is less than the length of the power stroke.

2. The internal combustion engine of claim 1 wherein the length of the compression stroke is less than 70% the length of the power stroke.

3. The internal combustion engine of claim 1 wherein the length of the compression stroke is less than 50% the length of the power stroke.

4. The internal combustion engine of claim 1 further comprising a piston reciprocating within a cylinder, a first gear moving in a planetary relationship with respect to a second gear, and the piston coupled to the first gear via a crank pin.

5. The internal combustion engine of claim 4 wherein the first and second gears have an effective gear ratio of 1:3.

6. The internal combustion engine of claim 5 wherein the first and second gears define a peripheral axis of rotation and a central axis of revolution, respectively, the peripheral axis revolves in a circular motion about the central axis of revolution, with radius r equal to the distance between the peripheral and central axes, and the crank pin is spaced from the peripheral axis of rotation at a distance greater than r.

7. A method of increasing the efficiency of a device producing usable power from internal combustion, the method comprising:

providing the device with a piston, a cylinder, a connecting rod, a crank pin, and a rotating crankshaft, operably connected such that the piston reciprocates within the cylinder, and energy from fuel combusted in the cylinder causes the crankshaft to rotate; and moving the crank pin in a manner that the piston has two top dead center points and two bottom dead center points during each 360° rotation of the crankshaft.

8. The method of claim 7 further comprising providing a planetary gear and carrying the crank pin with respect to the planetary gear such that the crank pin traces out a hypocycloid path.

9. The method of claim 7 further comprising operating the device to produce a compression stroke and a power stroke, where the compression stroke is shorter than the power stroke.

10. The method of claim 9 further comprising operating the device to produce an intake stroke and a scavenging stroke, all four said strokes occurring with the each 360° rotation of the crankshaft.

11. A reciprocating internal combustion engine comprising:

a first gear carrying a crank pin;

a second gear coupled in a planetary relationship with respect to said first gear such that said crank pin travels in a substantially hypocycloid path, said hypocycloid path completed during a single 360° rotation of the engine;

wherein the first and second gears have an effective gear ratio of 1:3; and the first and second gears define a peripheral axis of rotation and a central axis of revolution, the peripheral axis revolves in a circular motion about the central axis of revolution to define a radius r, and the crank pin is spaced from the peripheral axis of rotation at a distance greater than r.

12. A reciprocating internal combustion engine comprising:

a first gear carrying a crank pin;

a second gear coupled in a planetary relationship with respect to said first gear such that said crank pin travels in a substantially hypocycloid path, said hypocycloid path completed during a single 360° rotation of the engine;

wherein the first and second gears have an effective gear ratio of 1:3; and the engine further comprises a piston reciprocating in a cylinder to produce a compression stoke and a power stroke having unequal lengths.

* * * * *